US009874209B2

(12) United States Patent
Mauser et al.

(10) Patent No.: US 9,874,209 B2
(45) Date of Patent: Jan. 23, 2018

(54) VARIABLE DISPLACEMENT TRANSMISSION PUMP AND CONTROLLER WITH ADAPTIVE CONTROL

(71) Applicant: Magna Powertrain Bad Homburg GmbH, Bad Homburg (DE)

(72) Inventors: Thilo Mauser, Bad Vilbel (DE); Van Doan Nguyen, Neu-Anspach (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 312 days.

(21) Appl. No.: 14/612,621

(22) Filed: Feb. 3, 2015

(65) Prior Publication Data

US 2015/0226216 A1 Aug. 13, 2015

(30) Foreign Application Priority Data

Feb. 11, 2014 (DE) ..... 10 2014 101 638

(51) Int. Cl.
*F04C 14/24* (2006.01)
*F04C 14/22* (2006.01)
*F04C 2/344* (2006.01)

(52) U.S. Cl.
CPC ..... *F04C 14/223* (2013.01); *F04C 2/344* (2013.01); *F04C 2240/811* (2013.01);
(Continued)

(58) Field of Classification Search
CPC ..... F04C 14/24; F04C 14/223; F04C 14/226
(Continued)

(56) References Cited

U.S. PATENT DOCUMENTS 8,597,003 B2 * 12/2013 Krug ..... F04C 2/3442 403/141
2005/0232785 A1 10/2005 Scholl
2008/0069704 A1 * 3/2008 Armenio ..... F04C 14/223 417/310

FOREIGN PATENT DOCUMENTS

CN 101379296 A 3/2009
JP H02266153 A 10/1990
(Continued)

OTHER PUBLICATIONS

Franklin, Gene F., J. David Powell, Abbas Emami-Naeini, "Feedback Control of Dynamic Systems" 4th Ed., pp. 525, 586.*
(Continued)

*Primary Examiner* — Patrick Hamo
(74) *Attorney, Agent, or Firm* — Dickinson Wright PLLC

(57) ABSTRACT

A variable displacement transmission pump having a controller for adjusting the displaced volume, which controller actuates corresponding adjuster actuators of the adjustable pump via a control valve, so that the pump can be adjusted from minimum to maximum displaced volume in order to achieve a constant pump outlet pressure for supplying a hydraulically operated transmission, wherein for different operating points of both the adjustable pump and the transmission, the input variables of the controller are adjusted in such a way that, independently of the individual operating points, the overall damping of the control system comprising pump and transmission—that is, using corresponding influence variables from these systems—can be maintained substantially constant under variable operating conditions by means of adjustable controller amplification.

19 Claims, 2 Drawing Sheets

Figure 1:
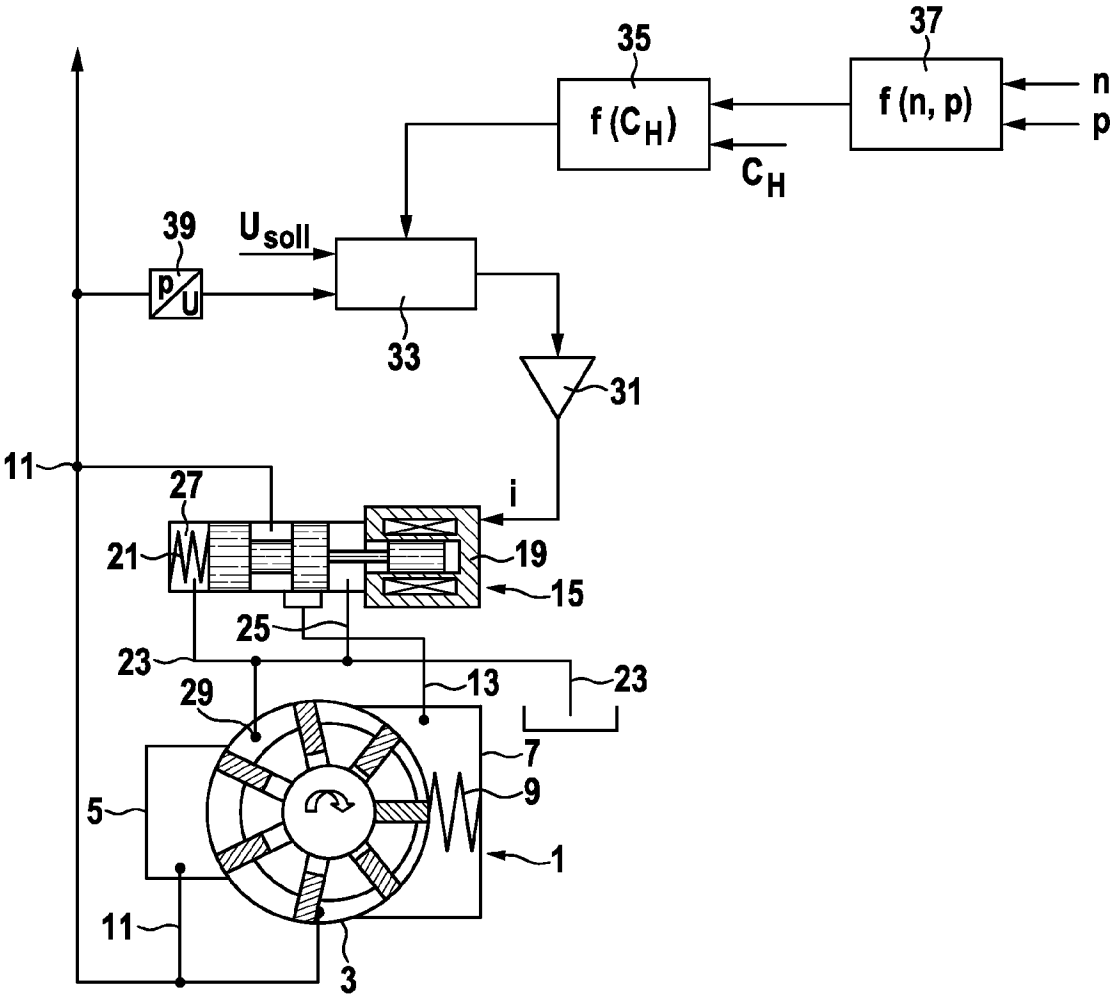

(52) U.S. Cl.
CPC .. *F04C 2270/052* (2013.01); *F04C 2270/185* (2013.01); *F04C 2270/205* (2013.01)

(58) Field of Classification Search
USPC ..... 417/220; 418/31
See application file for complete search history.

(56) References Cited

FOREIGN PATENT DOCUMENTS

| | | | |
|---|---|---|---|
| JP | H04347384 | A | 12/1992 |
| JP | 2012067642 | A | 4/2012 |

OTHER PUBLICATIONS

Search Report dated Dec. 14, 2016 in corresponding Chinese Patent Application Serial No. 201510062123.2.

* cited by examiner

VARIABLE DISPLACEMENT TRANSMISSION PUMP AND CONTROLLER WITH ADAPTIVE CONTROL

CROSS-REFERENCE TO RELATED APPLICATIONS

This application claims the benefit and priority of German Application No. DE 10 2014 101 638.6 filed Feb. 11, 2014. The entire disclosure of the above application is incorporated herein by reference.

FIELD

The present disclosure is related to a transmission pump especially a motor oil/lubrication pump with variable displacement and control. Control of the outlet pressure of a variable displacement transmission pump has the task of maintaining the pump outlet pressure constant independently of the amount of the volume flow of the consumer. For this purpose, the pump delivery rate is influenced in such a way that only the volume flow actually required by the consumer is delivered. The pressure control is implemented by hydraulic-mechanical means, a force difference acting on a differential piston being used as an input variable. This force difference must be selected to be appropriate for all operating points and must be set permanently prior to installation of the pump.

BACKGROUND

This section provides background information related to the present disclosure which is not necessarily prior art.

In modern passenger car automatic transmissions, the trend is toward wide pressure spreads (1 to 40 bar) and small delivery quantities (10 L per minute), in order to achieve the lowest possible power consumption by the pump and therefore greater efficiency of the transmission. Especially in the case of a pressure-controlled pump, this presents numerous problems. Above all, robust control stability is necessary for reliable operation of the pump in the transmission. However, with a constant controller gain designed for the critical operating point of the total system, a corresponding inertia in the dynamics and a huge controller deviation/hysteresis of the total system at non-critical operating points must necessarily be accepted.

SUMMARY

This section provides a general summary of the disclosure and is not intended to be a comprehensive disclosure of its full scope or of all its objectives and features.

It is therefore the object of the present disclosure to provide a pump system including a variable displacement transmission pump with a pressure control system and a corresponding controller which is configured to overcome the problems associated with conventional pumps.

The object is achieved by a pump system having a controller which actuates corresponding adjuster actuators of the adjustable pump via a control valve, so that the pump can be adjusted from a minimum to a maximum displaced volume in order to achieve a constant pump outlet pressure for supplying a hydraulically-operated transmission. Specifically, for different operating points of both the adjustable pump and the transmission, the input variables of the controller are adjusted in such a way that, independently of the individual operating points, the overall damping of the control system comprising the pump and the transmission—that is, using corresponding influence variables from these systems—can be maintained substantially constant under variable operating conditions by means of adjustable controller amplification.

The object is additionally achieved by a pump system constructed in accordance with the present disclosure wherein a pressure-dependence of the adjustable controller amplification is varied according to the equation $$V_R \sim \frac{1}{\sqrt{p}}$$

(p is the actual system pressure at the transmission inlet, VR is the controller amplification.)

In accordance with these objects, an inventive pump system constructed in accordance with the present disclosure is characterized in that a rotational-speed dependence of the adjustable controller amplification is defined by the equation $$V_R \sim \frac{1}{n}$$

(pump rotational speed).

An inventive pump system constructed in accordance with the present disclosure is characterized in that a delivery-rate dependence of the amplification $V_R$ is defined by the equation $V_R \sim Q^2$ (Q equals volume flow rate).

An inventive pump system constructed in accordance with the present disclosure is characterized in that the dependence of a load capacity comprising the transmission and line volumes, in particular the volumes of the transmission clutches subjected to pressure, is defined by the equation $$V_R \sim \frac{1}{(C_{HO} + \sum C_{H,i})},$$

where $C_{HO}$ represents the basic capacity of the lines subjected to pressure and volume flow, and $C_{H,i}$ represents the individual capacity of a respective transmission clutch subjected to pressure.

An inventive pump system constructed in accordance with the present disclosure is characterized in that a damping factor $D_0$, which is to be maintained constant overall in dependence on the operating point by this control system, is represented by the equation $$D_0 = \frac{G_L}{2}\sqrt{\frac{A_K}{V_R \cdot V_S \cdot V_V \cdot C_0 \cdot C_{0P} \cdot C_H}},$$

where $G_L$ corresponds to the conductance coefficient of a consumer throttle at the pump outlet, $A_K$ corresponds to the piston area at the actuator of the adjustable cam ring, $V_S$ corresponds to the transducer value of a pressure sensor, $V_V$ corresponds to the transmission value of a valve, $C_0$ corresponds to the flow amplification of a valve, $C_{0P}$ to the flow amplification of the pump, and $C_H$ corresponds to the total hydraulic line capacity between pump and the consumers terminating the line.

An inventive pump system constructed in accordance with the present disclosure is characterized in that the rotational speed n and the system pressure p are input and processed in a first region of the controller via corresponding signals.

An inventive pump system constructed in accordance with the present disclosure is characterized in that the output signal is processed in a second controller region together with a signal representing the total hydraulic line capacity $C_H$.

An inventive pump system constructed in accordance with the present disclosure is characterized in that the signal from the second controller region is fed to a third controller region in which it represents, together with a reference value $U_{Soll}$ and the signal of a pressure sensor at the pump outlet, the actual controller signal for adjusting a control valve which correspondingly activates the actuators or actuator in the pump for adjusting the displaced volume.

An inventive pump system constructed in accordance with the present disclosure is characterized in that the adjustable controller amplification decreases with increasing outlet pressure and/or with increasing pump rotational speed and/or with decreasing delivery rate and/or with increasing load volume.

An inventive pump system constructed in accordance with the present disclosure is characterized in that the adjustable controller amplification is increased with decreasing pump outlet pressure and/or with decreasing pump rotational speed and/or with increasing delivery rate of the pump and/or with decreasing load volume of the transmission.

An inventive pump system constructed in accordance with the present disclosure is characterized in that, as a result of the aforementioned controller amplification changes, the damping factor of the total control loop comprising pump and transmission, as the so-called load, remains substantially constant and therefore stable.

Further areas of applicability will become apparent from the description provided herein. The description and specific examples in this summary are intended for purposes of illustration only and are not intended to limit the scope of the present disclosure.

DRAWINGS

Figure 2:
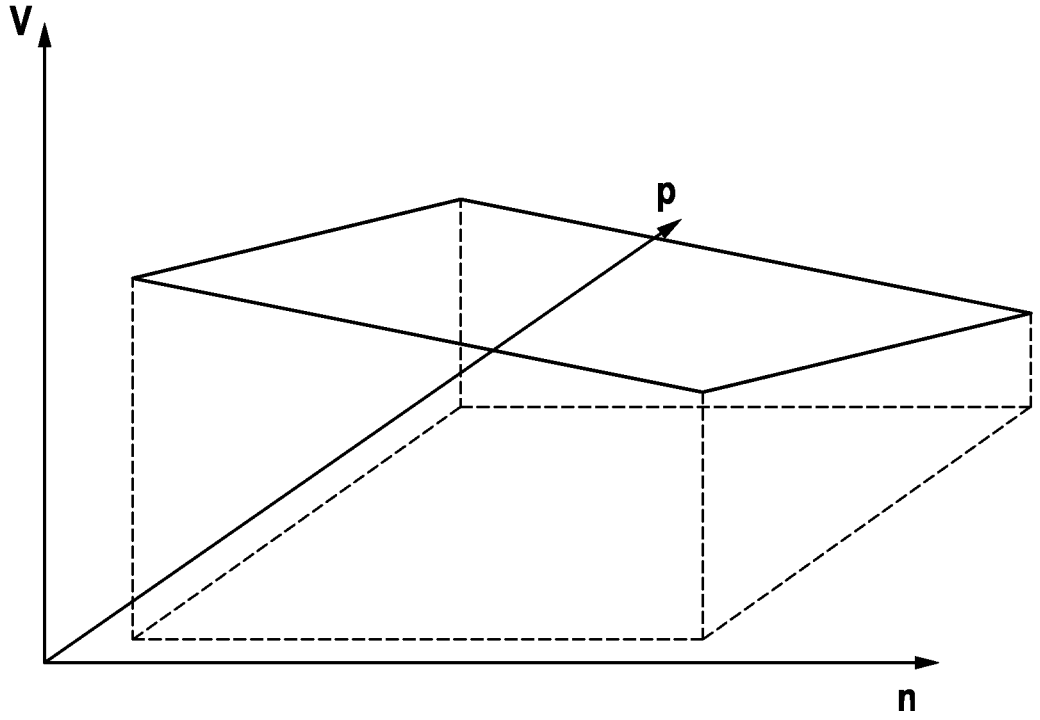

The invention will now be described with reference to the figures wherein:

FIG. 1 shows an inventive pump system having a variable displacement pump and a corresponding control system in accordance with the present disclosure; and FIG. 2 shows schematically in a diagram a dependency of the amplification V as a function of the system pressure p and the rotational speed n (pump outlet pressure and pump rotational speed and controller amplification V).

DETAILED DESCRIPTION

Example embodiments will now be described more fully with reference to the accompanying drawings.

FIG. 1 shows schematically an adjustable pump 1 such as, for example, an adjustable vane pump with an adjustable cam ring 3 which can be adjusted to various positions by a first actuator 5 and a second actuator 7 together with a spring 9. The first actuator 5 is subjected to the pump outlet pressure in the line 11, while the second actuator 7, which has an appropriately larger effective pressurized area than the first actuator 5, is subjected to a control pressure, which can be influenced by a control valve 15, in the feed line 13 of the second actuator 7. The control valve 15 can be supplied with the pump outlet pressure from the line 11, which leads further to the hydraulic consumer, in this case a transmission, and can be suitably varied according to the opening cross section of the control valve 15, which is adjustable by a proportional solenoid 19. The piston of the proportional control valve 15 has on one side a spring 21 and a pressure chamber 27, which leads via a essentially unpressurized line 23 to a tank or oil sump of the transmission, and has on the other side, between the proportional solenoid 19 and the valve piston, a further line 25, which is also connected to the tank pressure line 23. The spring 21 holds the equilibrium for a particular position against the force of the proportional solenoid 19 when the proportional solenoid 19 is energized with a corresponding solenoid current i supplied by a controller 33. The tank line or feed line to an oil sump 23 is further connected to the pump intake chamber 29. The current i for the proportional solenoid 19 is supplied by a suitable amplifier 31 which, in turn, receives its input variable from the controller 33. The controller 33 represents a total controller region comprising the regions 33, 35 and 37, which are also referred to as the first controller region 37, the second controller region 35 and the third controller region 33. The first controller region 37 processes, as input variables, the pump rotational speed n and the system pressure p supplied by the pump 1 to the transmission, to form the corresponding functions which describe the hydraulic and physical dependencies. The first controller region 37 generates a corresponding input signal for the second controller region 35, which additionally processes the hydraulic capacities $C_H$, which comprise the line volumes up to the corresponding consumers or the volumes which are present by virtue of the corresponding clutches in the automatic transmission and are pressurized correspondingly in order to actuate the clutch. The output signal 2 of this second controller region 35 is, in turn, supplied to the third controller region 33, which processes as further input signals the reference value $U_{soll}$ of the controller and the signal of a corresponding pressure sensor 39, the pressure sensor 39 capturing the outlet pressure towards the transmission inlet, meaning the system pressure, generated by the pump 1.

As a result of this arrangement of the pump, the pump controller and the pump control system, the controller amplification is adjustable as a function of the operating point of the hydraulic load system—that is, of both the transmission and the pump itself. In what follows, the concept of controller amplification encompasses all the controller components which operate proportionally, integrally and differentially. During a change in the controller amplification, moreover, only individual components of the controller amplification may be concerned, depending on the operating point of the total system. As a criterion for the controller amplification, the formula of the damping factor, for example for a simplified model of an electrohydraulic pump control system, is used. The pump pressure is controlled to a reference value. By means of the pressure sensor in the vicinity of the pump outlet, a signal which can be processed by this electrical controller is compared to the reference value and a control signal for the electrically activated hydraulic valve, the proportional valve, is output. Depending on the position of the valve, the pump is subjected to a hydraulically generated force which increases or reduces the displaced volume. The real damping factor of the pressure control system is influenced, in addition to the parameters specified in the formula, by losses in the valve, internal forces of the pump and leakages, which are disregarded here for simplicity. Therefore the damping factor result essentially in:

$$D_0 = \frac{G_L}{2}\sqrt{\frac{A_K}{V_R \cdot V_S \cdot V_V \cdot C_0 \cdot C_{0p} \cdot C_H}}$$

where $G_L$ is the conductance coefficient of a so-called consumer throttle, that is, of the total system of the transmission, at the pump outlet, $A_K$ is the piston area at the actuator (cam ring), $V_S$ is the transducer value of the pressure sensor, $V_V$ is the transmission value of the valve, $C_0$ is the flow amplification of the valve, $C_{0P}$ is the flow amplification of the pump, and $C_H$ is the hydraulic line capacity between pump and consumer.

The above-mentioned controller amplification, which is adaptively varied appropriately, is contained here as the constant $V_R$. The objective for the adjustable controller amplification should therefore be a constant damping factor under variable operating conditions. The controller amplification dependencies represented below are therefore yielded:

Pressure Dependence:

Since $C_0 \sim \sqrt{p}$, the controller amplification should be variable according to $$V_R \sim \frac{1}{\sqrt{p}}.$$

Rotational Speed Dependence:

The flow amplification of the pump $C_{0p}$ is proportional to the pump rotational speed; a controller amplification should therefore be adapted using $$V_R \sim \frac{1}{n}.$$

Displaced Quantity Dependence:

Since the conductance of the consumer throttle behaves proportionally to the displaced quantity Q, $$V_R \sim Q^2$$

applies as orientation for an adaptation of controller amplification.

Dependence on Line Capacity:

The hydraulic capacity between pump outlet and consumer is difficult to establish. However, as it is determined substantially by the number and size of the pressurized clutches in the transmission, it is appropriate to adapt the controller amplification when varying the pressurisations of the clutches in the transmission. When regulating a pump outlet pressure the following applies:

$$V_R \sim \frac{1}{C_R}.$$

Therefore, $$V_R \sim \frac{1}{(C_{HO} + \sum C_{H,i})}$$

may apply for a pump outlet pressure regulation, where $C_{H,i}$ is an individual capacity of a clutch and $C_{H0}$ is the basic capacity of the line.

FIG. 2 then shows schematically the interdependence between the controller amplification V (or $V_R$), the system pressure p (that is, the outlet pressure at the pump outlet or the inlet pressure for the transmission system), and the rotational speed n (that is, the pump rotational speed).

It can be seen purely schematically that as the system pressure p rises the controller amplification must fall, and that as the rotational speed n rises the amplification must likewise fall. Accordingly, this gives rise to an overall, three-dimensional input-output map to which the corresponding pump control system must conform in dependence on the operating point.

LIST OF REFERENCES

1 Pump
3 Cam ring
5 Actuator
7 Actuator
9 Spring
11 Line
13 Feed line
15 Control valve
19 Proportional solenoid
21 Spring
23 Line
25 Line
27 Pressure chamber
29 Pump intake chamber
31 Amplifier
33 Controller region
35 Controller region
37 Controller region
39 Pressure sensor

The invention claimed is:

1. A variable displacement transmission pump having a controller for adjusting a displaced volume of the pump, wherein the controller actuates corresponding adjuster actuators of the pump via a control valve so that the pump can be adjusted from a minimum to a maximum displaced volume in order to achieve a constant pump outlet pressure for supplying a hydraulically-operated transmission, wherein for a plurality of operating points of both the pump and the transmission, the input variables of the controller are adjusted in such a way that, independently of each of the operating points, the overall damping of a control system using corresponding influence variables from the pump and transmission can be maintained substantially constant under variable operating conditions by means of adjustable controller amplification and wherein a damping factor $D_0$, which is to be maintained constant overall in dependence on the operating point by the control system, is represented by the equation $$D_0 = \frac{G_L}{2}\sqrt{\frac{A_K}{V_R \cdot V_S \cdot V_V \cdot C_0 \cdot C_{0p} \cdot C_H}},$$

where $G_L$ corresponds to the conductance coefficient of a consumer throttle at the pump outlet, $A_K$ corresponds to the piston area at the actuator of the cam ring, $V_s$ corresponds to the transducer value of a pressure sensor, $V_v$ corresponds to the transmission value of a valve, $C_0$ corresponds to the flow amplification of a valve, $C_{0P}$ corresponds to the flow amplification of the pump, and $C_H$ corresponds to the total hydraulic line capacity between pump and the consumers terminating the line.

2. The variable displacement transmission pump according to claim 1, wherein a pressure-dependence of the adjustable controller amplification ($V_R$) is varied according to the equation $$V_R \sim \frac{1}{\sqrt{p}},$$

wherein p is a pump outlet pressure.

3. The variable displacement transmission pump according to claim 1, wherein a rotational-speed dependence of the adjustable controller amplification ($V_R$) is defined by the equation $$V_R \sim \frac{1}{n},$$

wherein n is a pump rotational speed.

4. The variable displacement transmission pump according to claim 1, wherein a delivery-rate dependence of the adjustable controller amplification ($V_R$) is defined by the equation $V_R \sim Q^2$, wherein Q is a volume flow rate.

5. The variable displacement transmission pump according to claim 1, wherein a rotational speed n and a system pressure p are input and processed in a first controller region of the controller via corresponding signals.

6. The variable displacement transmission pump according to claim 5, wherein an output signal is processed in a second controller region of the controller together with a signal representing the capacity $C_H$.

7. The variable displacement transmission pump according to claim 6, wherein the signal from the second controller region is fed to a third controller region in which it represents, together with a reference value $U_{Soll}$ and the signal of a pressure sensor at the pump outlet, the actual controller signal for adjusting the control valve which correspondingly activates the at least one of the actuators in the pump for adjusting the displaced volume.

8. The variable displacement transmission pump according to claim 1, wherein the controller amplification ($V_R$) decreases with increasing outlet pressure (p) and/or with increasing pump rotational speed (n) and/or with decreasing delivery rate and/or with increasing load volume (Q).

9. The variable displacement transmission pump according to claim 1, wherein the controller amplification ($V_R$) is increased with decreasing pump outlet pressure (p) and/or with decreasing pump rotational speed (n) and/or with increasing delivery rate of the pump and/or with decreasing load volume (Q) of the transmission.

10. The variable displacement transmission pump according to claim 1, wherein as a result of the aforementioned amplification ($V_R$) changes, the damping factor ($D_0$) of the total control loop comprising the pump and the transmission remains substantially constant and therefore stable.

11. A variable displacement transmission pump having a controller for adjusting displaced volume of the pump, wherein the controller actuates corresponding adjuster actuators of the pump via a control valve so that the pump can be adjusted from a minimum to a maximum displaced volume in order to achieve a constant pump outlet pressure for supplying a hydraulically-operated transmission, wherein for a plurality of operating points of both the pump and the transmission, the input variables of the controller are adjusted in such a way that, independently of each of the operating points, the overall damping of a control system using corresponding influence variables from the pump and transmission can be maintained substantially constant under variable operating conditions by means of adjustable controller amplification; and the dependence of a load capacity comprising volumes of lines and a clutch of the transmission is defined by the equation $$V_R \sim \frac{1}{(C_{HO} + \sum C_{H,i})},$$

where $C_{HO}$ represents the basic capacity of the lines subjected to pressure and volume flow, and $C_{H,i}$ represents the individual capacity of a respective clutch subjected to pressure.

12. A variable displacement transmission pump system for providing a fluid to a transmission comprising:

a cam ring defining a compartment;

the cam ring defining an intake chamber for receiving a fluid into the compartment;

an outlet line connected to the compartment and receiving fluid from the compartment and for delivering the fluid from the compartment to the transmission;

a rotor rotatably disposed in the compartment of the cam ring;

a plurality of vanes moveably connected to the rotor for moving the fluid within the chamber from the intake chamber to the outlet line;

a first actuator and a second actuator coupled with the cam ring for adjusting the position of the cam ring relative to the rotor for varying a displaced volume in the chamber and a pump outlet pressure during rotation of the rotor;

a control valve fluidly connected to the first and second actuators and configured to actuate the first and second actuators to adjust the position of the cam ring relative to the rotor; and a control system including a plurality of controller regions for providing outputs based on operating conditions of the pump and transmission, and an amplifier electrically connected to the control regions and the control valve for outputting a current to the control valve based on the outputs received from the plurality of control regions;

wherein for different operating points of both the pump and transmission, the control system is configured to adjust an amplification provided by the amplifier to vary the position of the control valve to move the actuators to adjust the first and second actuators such that a constant pump outlet pressure is provided in the outlet line.

13. The variable displacement transmission pump system according to claim 12, wherein a pressure-dependence of the amplification ($V_R$) of the amplifier is varied according to the equation $$V_R \sim \frac{1}{\sqrt{p}},$$

wherein p is a pump outlet pressure.

14. The variable displacement transmission pump system according to claim 12, wherein a rotational-speed dependence of the amplification ($V_R$) of the amplifier is defined by the equation $$V_R \sim \frac{1}{n},$$

wherein n is a pump rotational speed.

15. The variable displacement transmission pump system according to claim 12, wherein a delivery-rate dependence of the amplification ($V_R$) of the amplifier is defined by the equation $V_R \sim Q^2$, wherein Q is a volume flow rate.

16. The variable displacement transmission pump system according to claim 12, wherein the dependence of a load capacity comprising volumes of lines and a clutch of the transmission is defined by the equation $$V_R \sim \frac{1}{(C_{HO} + \sum C_{H,i})},$$

wherein $C_{HO}$ represents the basic capacity of the lines subjected to pressure and volume flow, and $C_{H,i}$ represents the individual capacity of a respective clutch subjected to pressure.

17. The variable displacement transmission pump system according to claim 12, wherein a damping factor $D_0$, which is to be maintained constant overall in dependence on the operating point by the control system, is represented by the equation $$D_0 = \frac{G_L}{2}\sqrt{\frac{A_K}{V_R \cdot V_S \cdot V_V \cdot C_O \cdot C_{OP} \cdot C_H}},$$

where $G_L$ corresponds to the conductance coefficient of a consumer throttle at the pump outlet, $A_K$ corresponds to the piston area at the actuator of the cam ring, $V_S$ corresponds to the transducer value of a pressure sensor, $V_v$ corresponds to the transmission value of a valve, $C_0$ corresponds to the flow amplification of a valve, $C_{0P}$ corresponds to the flow amplification of the pump, and $C_H$ corresponds to the total hydraulic line capacity between pump and the consumers terminating the line.

18. The variable displacement transmission pump system according to claim 12, wherein the plurality of controller regions includes a first controller region, and wherein a rotational speed n and a system pressure p are input and processed in the first controller region of the controller via corresponding signals.

19. The variable displacement transmission pump system according to claim 18, wherein the plurality of controller regions further includes a second controller region, and wherein an output signal is processed in the second controller region of the controller together with a signal representing the capacity $C_H$.

* * * * *